US010604310B2

(12) United States Patent
Kutsuzawa et al.

(10) Patent No.: US 10,604,310 B2
(45) Date of Patent: Mar. 31, 2020

(54) DISCHARGE CONTAINER

(71) Applicant: YOSHINO KOGYOSHO CO., LTD., Tokyo (JP)

(72) Inventors: Shintaro Kutsuzawa, Tokyo (JP); Keisuke Miyairi, Tokyo (JP); Takayuki Honda, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 16/333,575

(22) PCT Filed: Sep. 28, 2017

(86) PCT No.: PCT/JP2017/035346
§ 371 (c)(1),
(2) Date: Mar. 14, 2019

(87) PCT Pub. No.: WO2018/062436
PCT Pub. Date: Apr. 5, 2018

(65) Prior Publication Data

US 2019/0256257 A1 Aug. 22, 2019

(30) Foreign Application Priority Data

Sep. 30, 2016 (JP) ..... 2016-194984

(51) Int. Cl.
*B65D 47/20* (2006.01)
*B65D 47/08* (2006.01)
(Continued)

(52) U.S. Cl.
CPC ..... *B65D 47/2056* (2013.01); *B65D 1/02* (2013.01); *B65D 47/08* (2013.01);
(Continued)

(58) Field of Classification Search
CPC ..... B65D 47/2056; B65D 51/1661; B65D 47/0838; B65D 2205/02
See application file for complete search history.

(56) References Cited

U.S. PATENT DOCUMENTS

2014/0144938 A1* 5/2014 Kakuta ..... B65D 35/14 222/105
2015/0001260 A1* 1/2015 Hoshino ..... B65D 47/40 222/481
2016/0145015 A1* 5/2016 Hoshino ..... B65D 83/0055 222/130

FOREIGN PATENT DOCUMENTS

JP 2007-099381 A 4/2007
JP 2008-162666 A 7/2008
(Continued)

OTHER PUBLICATIONS

Nov. 14, 2017 International Search Report issued in International Patent Application No. PCT/JP2017/035346.
(Continued)

*Primary Examiner* — Donnell A Long
(74) *Attorney, Agent, or Firm* — Oliff PLC

(57) ABSTRACT

A discharge container has: a container body and an inner layer body; a discharge cap; and a valve, wherein the discharge cap includes a top wall portion having the discharge port, and a cylindrical side wall portion connected to the top wall portion, and an annular second seal portion and a second engagement portion are provided at an inner peripheral surface of the side wall portion, the second seal portion abutting against a first seal portion of the mouth portion located below the outside air introduction hole on a whole circumference, and the second engagement portion undercut-engaging with a first engagement portion located at an outer peripheral surface of the mouth portion above the first seal portion.

12 Claims, 2 Drawing Sheets

(51) Int. Cl.

| | |
|---|---|
| ***B65D 51/16*** | (2006.01) |
| ***B65D 1/02*** | (2006.01) |
| ***B65D 77/04*** | (2006.01) |

(52) U.S. Cl.
CPC ..... *B65D 47/0838* (2013.01); *B65D 51/1661* (2013.01); *B65D 77/04* (2013.01); *B65D 2205/02* (2013.01)

(56) References Cited

FOREIGN PATENT DOCUMENTS

| | | | |
|---|---|---|---|
| JP | 2012-076758 | A | 4/2012 |
| JP | 2015-227175 | A | 12/2015 |
| JP | 2016-141431 | A | 8/2016 |

OTHER PUBLICATIONS

Apr. 2, 2019 International Preliminary Report on Patentability issued in International Patent Application No. PCT/JP2017/035346.
Nov. 4, 2019 Office Action issued in Chinese Patent Application No. 201780057439.X.
Jan. 21, 2020 Office Action issued in Japanese Patent Application No. 2016-194984.

* cited by examiner

DISCHARGE CONTAINER

TECHNICAL FIELD

The present disclosure relates to a discharge container including: a container body that includes an outer layer body and an inner layer body; and a discharge cap that has a discharge port and is attached to a mouth portion.

BACKGROUND

A conventionally known discharge container for containing cosmetics such as a skin lotion, a shampoo, a hair conditioner, a liquid soap, a food seasoning, a medicine, or the like as contents includes: a container body of a double container structure composed of an outer layer body and an inner layer body; and a discharge cap that has a discharge port for discharging the contents and is attached to a mouth portion (see JP 2008-162666 A (PTL 1)). In the discharge container, the mouth portion of the container body has an outside air introduction hole passing through the outer layer body. Through the outside air introduction hole, outside air is taken into the internal space between the outer layer body and the inner layer body. A valve that opens and closes the flow path of the contents is located on the inner side of the discharge cap. The valve allows the contents to move from the containment space to the discharge port, and also prevents the contents or outside air from entering the containment space from the discharge port.

In the discharge container with such a structure, when discharging the contents, the valve prevents outside air from entering the container body from the discharge port. Moreover, outside air is introduced into the internal space between the outer layer body and the inner layer body from a suction hole formed in the discharge cap through the outside air introduction hole of the mouth portion. This enables volume-reduction deformation of only the inner layer body. Hence, the contents in the container body can be discharged without being replaced with outside air. The contents remaining in the containment space of the container body are kept from being in contact with air, and thus prevented from degradation or degeneration.

CITATION LIST

Patent Literature

PTL 1: JP 2008-162666 A

SUMMARY

Technical Problem

The above-described discharge container uses a discharge cap of screw type including a female screw portion that engages with a male screw portion provided on the outer peripheral surface of the mouth portion. However, an effective way of achieving high tamper-resistance effect is to use a cap of push-on type (stroke-stopper type) that is difficult to be reattached after opened.

Besides, in such a discharge container in which the mouth portion has an outside air introduction hole and a discharge cap is attached so as to cover the outside air introduction hole, the provision of the outside air introduction hole tends to cause the height of the mouth portion in the axial direction to increase, and accordingly causes the height of the discharge cap to increase.

It could therefore be helpful to provide a discharge container having a structure capable of reducing the height of the mouth portion of the container body.

Solution to Problem

A discharge container according to the present disclosure comprises: a container body that includes an outer layer body having an outside air introduction hole in a mouth portion, and an inner layer body contained on an inner side of the outer layer body and capable of volume-reduction deformation; a discharge cap that has a discharge port for discharging contents, and is attached to the mouth portion; and a valve that opens and closes a flow path of the contents on an inner side of the discharge cap, wherein the discharge cap includes a top wall portion having the discharge port, and a cylindrical side wall portion connected to the top wall portion, and an annular second seal portion and a second engagement portion are provided at an inner peripheral surface of the side wall portion, the second seal portion abutting against a first seal portion of the mouth portion located below the outside air introduction hole on a whole circumference, and the second engagement portion undercut-engaging with a first engagement portion located at an outer peripheral surface of the mouth portion above the first seal portion.

Preferably, in the discharge container according to the present disclosure, the container body includes a neck ring located below the first seal portion with a spacing and projecting radially outward, and a lower surface of the neck ring forms a capping support surface supported by a support when pushing the discharge cap onto the mouth portion.

Preferably, in the discharge container according to the present disclosure, a lower surface of the first seal portion forms a conveyance support surface supported by a conveyance tool when conveying the container.

Preferably, in the discharge container according to the present disclosure, an annular projection projecting radially outward is provided between the first seal portion and the neck ring, and a lower surface of the projection forms a conveyance support surface supported by a conveyance tool when conveying the container.

Preferably, in the discharge container according to the present disclosure, the neck ring has a notch-shaped groove portion that is a radially inward depression from an outer surface.

Preferably, in the discharge container according to the present disclosure, the outer peripheral surface of the mouth portion includes: a first straight surface that is located above the outside air introduction hole and whose contour line in a longitudinal sectional view passing through a central axis of the mouth portion is a straight line approximately parallel to the central axis; and a second straight surface that is connected to an upper part of the first straight surface via a step portion and is smaller in diameter than the first straight surface.

Advantageous Effect

It is thus possible to provide a discharge container having a structure capable of reducing the height of the mouth portion of the container body.

DETAILED DESCRIPTION

More detailed description will be given below with reference to drawings. Herein, "upper" or "up" denotes the discharge cap side relative to the container body side when a discharge container is placed on a horizontal surface in a standing position (upper side in FIG. 1), and "lower" or "down" denotes the side opposite to the upper side (lower side in FIG. 1).

Figure 1:
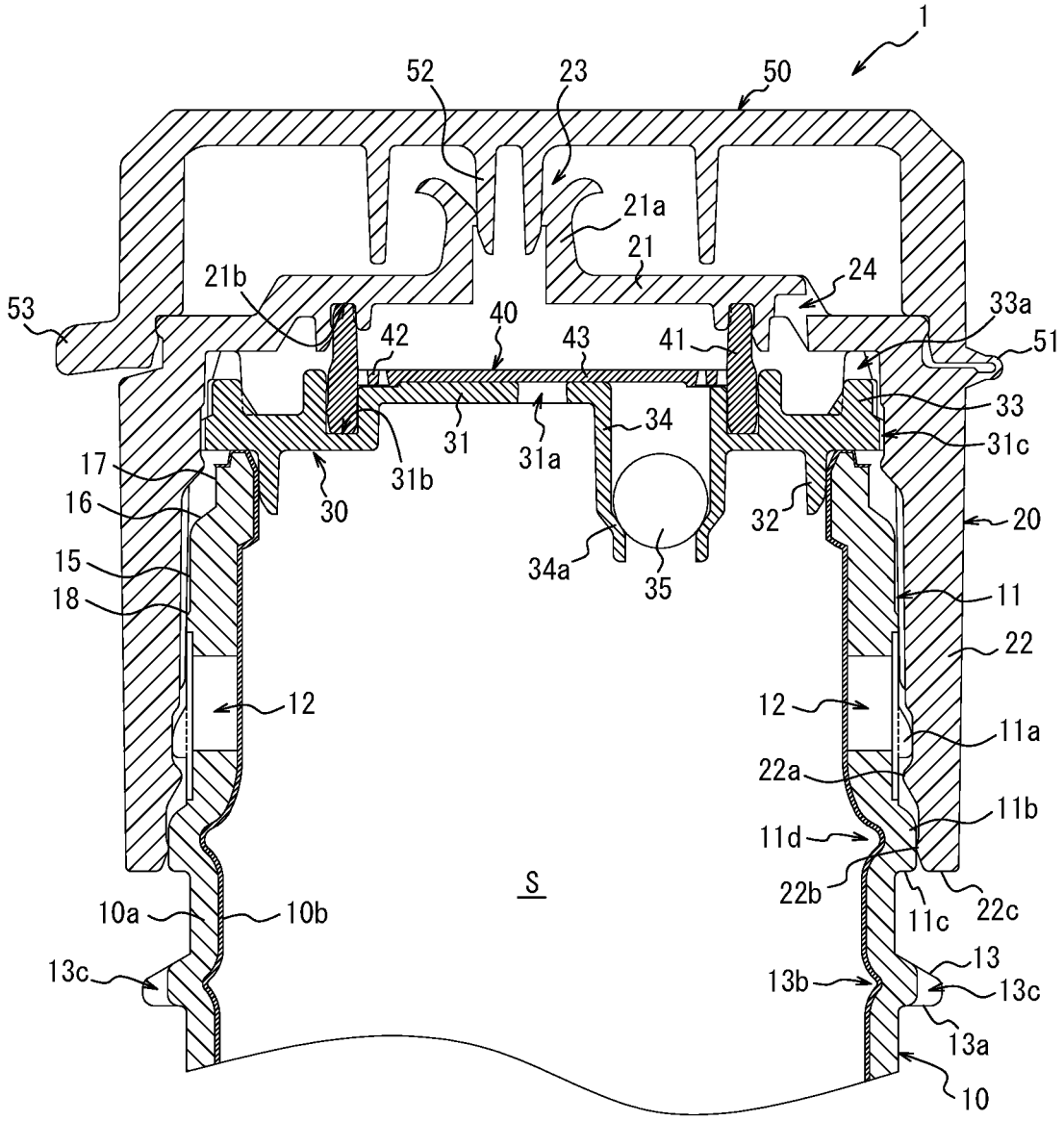
FIG. 1 is a sectional view of main parts of a discharge container according to one of the disclosed embodiments in a side view.

A discharge container 1 according to one of the disclosed embodiments includes a container body 10, a discharge cap 20, an inside plug 30, a valve 40, and a lid 50, as illustrated in FIG. 1. The discharge container 1 can contain various contents.

The container body 10 has a bottle shape including a cylindrical mouth portion 11 and, below the mouth portion 11, a barrel portion and a bottom portion, although not illustrated in detail.

In this embodiment, the container body 10 has a double container structure including an outer layer body 10*a* and an inner layer body 10*b* contained on the inner side of the outer layer body 10*a*. The container body 10 can be formed by extrusion blow molding, that is, blow molding a laminated parison including a layer for forming the outer layer body 10*a* and a layer for forming the inner layer body 10*b* using a mold. Although the container body 10 is a delamination container in which the inner layer body 10*b* is laminated on the inner surface of the outer layer body 10*a* so as to be peelable in this example, the container body 10 is not limited to such. The container body 10 may have a double container structure of embedded type in which the inner layer body 10*b* is embedded in the outer layer body 10*a*.

The inner layer body 10*b* is made of, for example, synthetic resin material in a thin-walled bag shape capable of volume-reduction deformation, and laminated on the inner surface of the outer layer body 10*a* so as to be peelable. The inner layer body 10*b* extends around to the open end of the mouth portion 11 of the container body 10 and opens at the open end. The inside of the inner layer body 10*b* is the containment space S for the contents.

The outer layer body 10*a* is made of, for example, synthetic resin material in a bottle shape having predetermined rigidity, thus forming the outer shell of the container body 10. The part of the outer layer body 10*a* corresponding to the barrel portion is pressable (squeezable), and is capable of restoring its original shape. The part of the outer layer body 10*a* corresponding to the mouth portion 11 has an outside air introduction hole 12 that passes through the outer layer body 10*a* in the radial direction and communicates with the space between the inner layer body 10*b* and the outer layer body 10*a*. Although two outside air introduction holes 12 are formed on the opposite sides of the central axis of the mouth portion 11 in the drawing, the number of outside air introduction holes 12 may be one or more. The outer peripheral surface of the mouth portion 11 includes: a first straight surface 15 that is located above the outside air introduction hole 12 and whose contour line in a longitudinal sectional view passing through the central axis of the mouth portion 11 is a straight line approximately parallel to the central axis; a first step portion 16 (step portion) that is connected to the upper part of the first straight surface 15 and inclined in a taper shape upward; and a second straight surface 17 that is connected to the upper part of the first step portion 16 and whose contour line in a longitudinal sectional view is a straight line approximately parallel to the central axis. The first straight surface 15 can be used to guide the inner peripheral surface of the discharge cap 20 at the time of capping (i.e. pushing the discharge cap 20 onto the mouth portion 11), so that the discharge cap 20 can be attached to the mouth portion 11 in a stable position. The region of the second straight surface 17 provided above the first straight surface 15 with the first step portion 16 therebetween is smaller in diameter than the region of the first straight surface 15. Hence, the mouth portion 11 can be easily inserted into the discharge cap 20 from below. The inclined surface of the first step portion 16 also enables smoother attachment of the discharge cap 20 to the mouth portion 11. In this embodiment, a second step portion 18 is provided below the first straight surface 15, and the part below the second step portion 18 is slightly larger in diameter than the first straight surface 15.

A first engagement portion 11*a* for holding the discharge cap 20 so as not to slip off is formed integrally at the outer peripheral surface of the outer layer body 10*a* forming the mouth portion 11. The first engagement portion 11*a* is intermittent in the circumferential direction, and differs in position in the circumferential direction from the outside air introduction hole 12. By staggering the first engagement portion 11*a* and the outside air introduction hole 12 in the circumferential direction in this way, their positions in the vertical direction can be made to overlap each other. This makes it possible to reduce the height of the mouth portion 11. The first engagement portion 11*a* is located at a position that partially overlaps the outside air introduction hole 12 in the axial direction along the central axis of the mouth portion 11 (the vertical direction in this example) and extends lower than the outside air introduction hole 12.

The vertical position (height) of the first engagement portion 11*a* is preferably lower than that of the outside air introduction hole 12. This enhances stability when pushing the discharge cap 20. For example, in the case where the first engagement portion 11*a* is located higher than the outside air introduction hole 12, when pushing the discharge cap 20, the first engagement portion 11*a* comes into contact with the discharge cap 20 at an early stage. This makes it difficult to push the discharge cap 20 straight, and causes the position of the discharge cap 20 to be unstable. In the case where the first engagement portion 11*a* is located lower than the outside air introduction hole 12 as in this embodiment, on the other hand, the outer peripheral surface of the upper part of the mouth portion 11 functions to guide the discharge cap 20. This contributes to more stable position of the discharge cap 20 at the time of capping.

A first seal portion 11*b* which is an annular protrusion projecting radially outward is formed integrally below the first engagement portion 11*a*. In this embodiment, a lower surface 11*c* of the first seal portion 11*b* forms a conveyance support surface supported by a conveyance tool when conveying the container body 10. The lower surface 11*c* of the first seal portion 11*b* is located at the same height as or lower than a lower end surface 22*c* of a side wall portion 22 of the discharge cap 20 in a state of being attached to the mouth portion 11 (attached state). Thus, even when conveying the container body 10 with the discharge cap 20 in the attached state, the container body 10 can be conveyed while supporting the lower surface 11*c* of the first seal portion 11*b* by the conveyance tool. The lower surface 11*c* of the first seal portion 11*b* forms a flat surface perpendicular to the axial direction. With such a structure, the container body 10 can be conveyed more stably.

An annular depression 11*d* which is a radially outward depression is formed at the inner surface of the part where the first seal portion 11*b* is formed. If the depression 11*d* is excessively deep, the wall thickness of the first seal portion 11*b* decreases. This may cause lower strength, or make it difficult to peel the inner layer body 10*b* from the outer layer body 10*a*. Therefore, the depth of the depression 11*d* is preferably as shallow as possible. The inner surface of the part where the first seal portion 11*b* is formed is preferably nearly flat.

A neck ring 13 projecting radially outward is provided below the first seal portion 11*b*. Since the lower surface 11*c* of the first seal portion 11*b* forms a conveyance support surface when conveying the container body 10, a space in which the conveyance tool can be inserted is formed between the first seal portion 11*b* and the neck ring 13. A lower surface 13*a* of the neck ring 13 forms a capping support surface supported by a support when attaching the discharge cap 20 to the mouth portion 11 by capping (push-on).

In this embodiment, the neck ring 13 is located at a predetermined spacing from the lower end surface 22*c* of the side wall portion 22 of the discharge cap 20 in the attached state. When the discharge cap 20 is pushed down firmly at the time of capping, the lower end surface 22*c* of the discharge cap 20 may elastically deform and project to a lower position than the expected position. In such a case, if the neck ring 13 is located nearby, there is a possibility that the lower end surface 22*c* of the side wall portion 22 and the neck ring 13 come into contact with each other. By locating the neck ring 13 at a predetermined spacing from the lower end surface 22*c* of the side wall portion 22, the lower end surface 22*c* of the side wall portion 22 and the neck ring 13 are kept from coming into contact with each other at the time of capping. Hence, deformation or damage of the discharge cap 20 and the container body 10 can be prevented reliably.

An annular depression 13*b* is formed at the inner surface of the part where the neck ring 13 is provided. If the depression 13*b* is excessively deep, the strength of the neck ring 13 may decrease, or the peelability of the inner layer body 10*b* from the outer layer body 10*a* may decrease. Therefore, the depth of the depression 13*b* is preferably as shallow as possible. In this embodiment, the neck ring 13 has a notch-shaped groove portion 13*c* which is a radially inward depression from the outer surface. Although the groove portion 13*c* is provided at a plurality of locations in the circumferential direction in this example, the groove portion 13*c* is not limited to such, and may be provided at one location. With such a groove portion 13*c*, the depth of the depression 13*b* on the inner surface side decreases, with it being possible to increase strength (so as to withstand the force of pushing the discharge cap 20). Moreover, the depression 13*b* can be made gentler in angle, so that the peelability of the inner layer body 10*b* from the outer layer body 10*a* can be improved.

The container body 10 may include, between the outer layer body 10*a* and the inner layer body 10*b*, a plurality of adhesion layers (adhesion bands) extending in the vertical direction and partially adhering the inner layer body 10*b* to the outer layer body 10*a*. The container body 10 may include a barrier layer having barrier property against, for example, oxygen or water vapor. The container body 10 may include various coatings to enhance barrier property.

The discharge cap 20 is made of, for example, synthetic resin material, and attached to the mouth portion 11 of the container body 10 so as to surround the inside plug 30. The discharge cap 20 has a topped cylindrical shape including a top wall portion 21 located above a partition wall 31 of the inside plug 30 and a cylindrical side wall portion 22 connected to the top wall portion 21 and located on the radially outer side of the mouth portion 11. A second engagement portion 22*a* is provided at the inner peripheral surface of the side wall portion 22. The second engagement portion 22*a* is fitted with the first engagement portion 11*a* provided at the outer peripheral surface of the mouth portion 11, as a result of which the discharge cap 20 is fixed to and held by the mouth portion 11 of the container body 10. The second engagement portion 22*a* may be an annular protrusion or depression. Alternatively, the second engagement portion 22*a* may be a protrusion or depression formed intermittently in the circumferential direction.

A discharge cylinder 21*a* projecting upward from the top wall portion 21 is formed integrally with the top wall portion 21. The inner side of the discharge cylinder 21*a* forms a discharge port 23 for the contents. The top wall portion 21 has a suction hole 24 for taking in outside air. An air flow path from the suction hole 24 to the outside air introduction hole 12 is formed between the mouth portion 11 and the side wall portion 22. For example, the air flow path can be formed by forming a groove portion at at least one of the outer peripheral surface of the mouth portion 11 and the inner peripheral surface of the side wall portion 22, or by forming a projection at at least one of the outer peripheral surface of the mouth portion 11 and the inner peripheral surface of the side wall portion 22 and creating a clearance therebetween. A second seal portion 22*b* that abuts airtight against the outer surface of the first seal portion 11*b* on the whole circumference and hermetically seals the air flow path is formed at the lower end of the side wall portion 22. Although the second seal portion 22*b* is an annular projection slightly projecting from the inner peripheral surface of the side wall portion 22 in this embodiment, the second seal portion 22*b* may not project from the inner peripheral surface of the side wall portion 22.

The inside plug 30 is made of, for example, synthetic resin material, and attached to the inner side of the discharge cap 20. The inside plug 30 includes a partition wall 31 that covers the opening of the mouth portion 11, a seal cylindrical portion 32 that projects from the lower surface of the partition wall 31 and abuts against the inner peripheral surface of the mouth portion 11 (the inner peripheral surface of the inner layer body 10*b*), and a support cylindrical portion 33 that extends upward from the outer peripheral edge of the partition wall 31. The outer diameter of the seal cylindrical portion 32 is preferably slightly larger than the inner diameter of the mouth portion 11. This enables the outer peripheral surface of the seal cylindrical portion 32 to firmly abut against the inner peripheral surface of the mouth portion 11, thus enhancing airtightness.

The support cylindrical portion 33 has its upper end abut against the lower surface of the top wall portion 21, and is fitted with the inner surface of the side wall portion 22 on its outer periphery. Thus, the inside plug 30 is fixed and held inside the discharge cap 20.

A contents outflow hole 31*a* passing through the partition wall 31 is formed in the center part of the partition wall 31. The outflow hole 31*a* can communicate with the discharge port 23 in the discharge cap 20. The contents contained in the containment space S can flow toward the discharge port 23 via the outflow hole 31*a*. An annular groove 31*b* that surrounds the outflow hole 31*a* on the radially inner side of the support cylindrical portion 33 is formed at the upper surface of the partition wall 31 of the inside plug 30. The partition wall 31 has a ventilation groove 31*c* passing through the partition wall 31 in the vertical direction, at its outer peripheral edge. The support cylindrical portion 33 has a communicating groove 33*a* communicating with the ventilation groove 31*c*.

The partition wall 31 is provided with a cylindrical wall 34 passing through (extending) in the vertical direction. The lower part of the cylindrical wall 34 has a diameter decrease portion 34*a* that decreases in diameter downward. A movable valve 35 movable in the axial direction of the cylindrical wall 34 is placed on the inner side of the cylindrical wall 34. Although the movable valve 35 is spherical in the drawing, the movable valve 35 is not limited to such, and may have various shapes.

The valve 40 is located between the top wall portion 21 of the discharge cap 20 and the partition wall 31 of the inside plug 30, and opens and closes the outflow hole 31*a* in the partition wall 31. Specifically, the valve 40 allows for the movement of the contents from the containment space S to the discharge port 23, and prevents the inflow of the contents or outside air from the discharge port 23 to the containment space S. The valve 40 is made of, for example, low density polyethylene (soft polyethylene), and includes a cylindrical base 41 and a disk valve body 43 integrally connected to the inner side of the base 41 via an elastic piece 42. The upper end of the base 41 is fitted into the annular groove 21*b* at the lower surface of the top wall portion 21. The lower end of the base 41 is fitted into the annular groove 31*b* in the partition wall 31 of the inside plug 30. Thus, the valve 40 is fixed and held between the discharge cap 20 and the inside plug 30. Although the valve 40 is in a three-point valve form in which the valve body 43 is supported by three elastic pieces 42 in this embodiment, a check valve of any other form, such as a one-point valve in which the valve body 43 is supported by one hinge, may be used. A contents flow path from the outflow hole 31*a* in the partition wall 31 to the discharge port 23 in the top wall portion 21 is formed on the inner side of the base 41. An air flow path from the suction hole 24 to the communicating groove 33*a* and the ventilation groove 31*c* is formed on the outer side of the base 41.

The lid 50 has a topped cylindrical shape with approximately the same diameter as the discharge cap 20. The lid 50 is rotatably connected to the side wall portion 22 of the discharge cap 20 by a hinge 51, and thus can cover the discharge cylinder 21*a*. A cylindrical seal wall portion 52 is integrally formed at the inner surface of the lid 50. When the lid 50 is closed, the seal wall portion 52 is fitted with the inner side of the discharge cylinder 21*a*, to close the discharge port 23. A grip portion 53 on which a finger is placed when opening the lid 50 is provided on the side of the lid 50 opposite to the hinge 51.

When discharging the contents from the discharge container 1, while the discharge container 1 is set in a tilted position in which the container body 10 is inclined so that the discharge cylinder 21*a* faces downward in an open state of the lid 50, the barrel portion is squeezed. As a result, the inner layer body 10*b* is pressed to force the contents toward the outflow hole 31*a*. Thus, the valve body 43 is opened to cause the contents in the containment space S to flow out of the outflow hole 31*a* toward the discharge port 23. The contents can then be discharged from the discharge port 23 to the outside.

When stopping squeezing the barrel portion after discharging the contents, the outflow hole 31*a* is closed by the valve body 43, and air (outside air) is introduced from the suction hole 24 due to negative pressure generated when the outer layer body 10*a* restores its original shape. The air introduced from the suction hole 24 flows through the air flow path formed by the communicating groove 33*a*, the ventilation groove 31*c*, the clearance between the mouth portion 11 and the side wall portion 22, and the like, into the internal space between the inner layer body 10*b* and the outer layer body 10*a*. By introducing outside air between the inner layer body 10*b* and the outer layer body 10*a* in this way, the outer layer body 10*a* can restore its original shape while the inner layer body 10*b* remains volume-reduction deformed. The introduction of outside air into the containment space S can thus be suppressed to reduce the contact of the contents in the container body 10 with air and prevent the contents from degeneration or degradation. When the discharge container 1 is set in a tilted position to discharge the contents, the movable valve 35 moves to the valve body 43 side. When the discharge of the contents ends and the discharge container 1 is returned to the original erected position from the tilted position, the movable valve 35 moves to the diameter decrease portion 34*a* side. With this, the contents in the discharge cylinder 21*a* can be drawn to the cylindrical wall 34 side via the clearance between the elastic piece 42 and the valve body 43. By such a suck back function, dripping from the discharge cylinder 21*a* can be prevented.

In the discharge container 1 with this structure, the first engagement portion 11*a* is located above the first seal portion 11*b* of the mouth portion 11. At the corresponding inner peripheral surface of the discharge cap 20, the second seal portion 22*b* is located at the lower end of the side wall portion 22, and the second engagement portion 22*a* that engages with the first engagement portion 11*a* is located above the second seal portion 22*b*. This enables attachment of the discharge cap 20 to the container body 10 by capping, and also seals the air flow path formed on the inner side of the side wall portion 22 by the second seal portion 22*b*. Such a structure ensures airtightness while reducing the height of the mouth portion 11. For example, suppose the vertical positions of the first engagement portion 11*a* and the first seal portion 11*b* of the mouth portion 11 are reversed. Since the first seal portion 11*b* needs to abut against the outer peripheral surface of the mouth portion 11 on the whole circumference in order to maintain airtightness, the first seal portion 11*b* needs to be located lower than the outside air introduction hole 12. The first engagement portion 11*a* is then located lower than the first seal portion 11*b*. This causes the vertical size (height) of the mouth portion 11 to increase. In the discharge container 1 according to this embodiment, on the other hand, the first seal portion 11*b* is located below the first engagement portion 11*a*, so that the outside air introduction hole 12 and the first engagement portion 11*a* can be arranged at the same height. The height of the mouth portion 11 can thus be reduced. Such a lower height of the mouth portion 11 contributes to a lower height of the side wall portion 22 of the discharge cap 20, with it being possible to make the container more compact.

Moreover, the provision of the neck ring 13 makes it possible to withstand downward stress applied at the time of capping. In particular, by forming the lower surface 13*a* of the neck ring 13 as a flat capping support surface perpendicular to the axis of the container, it is possible to withstand greater stress.

In the discharge container 1 according to this embodiment, the discharge cap 20 undercut-engages with the mouth portion 11. This produces higher tamper-resistance effect than a discharge cap of screw type.

Another one of the disclosed embodiments will be described below. Parts having the same basic functions as those in the foregoing embodiment are given the same reference signs in the drawings, and their description is omitted.

Figure 2:
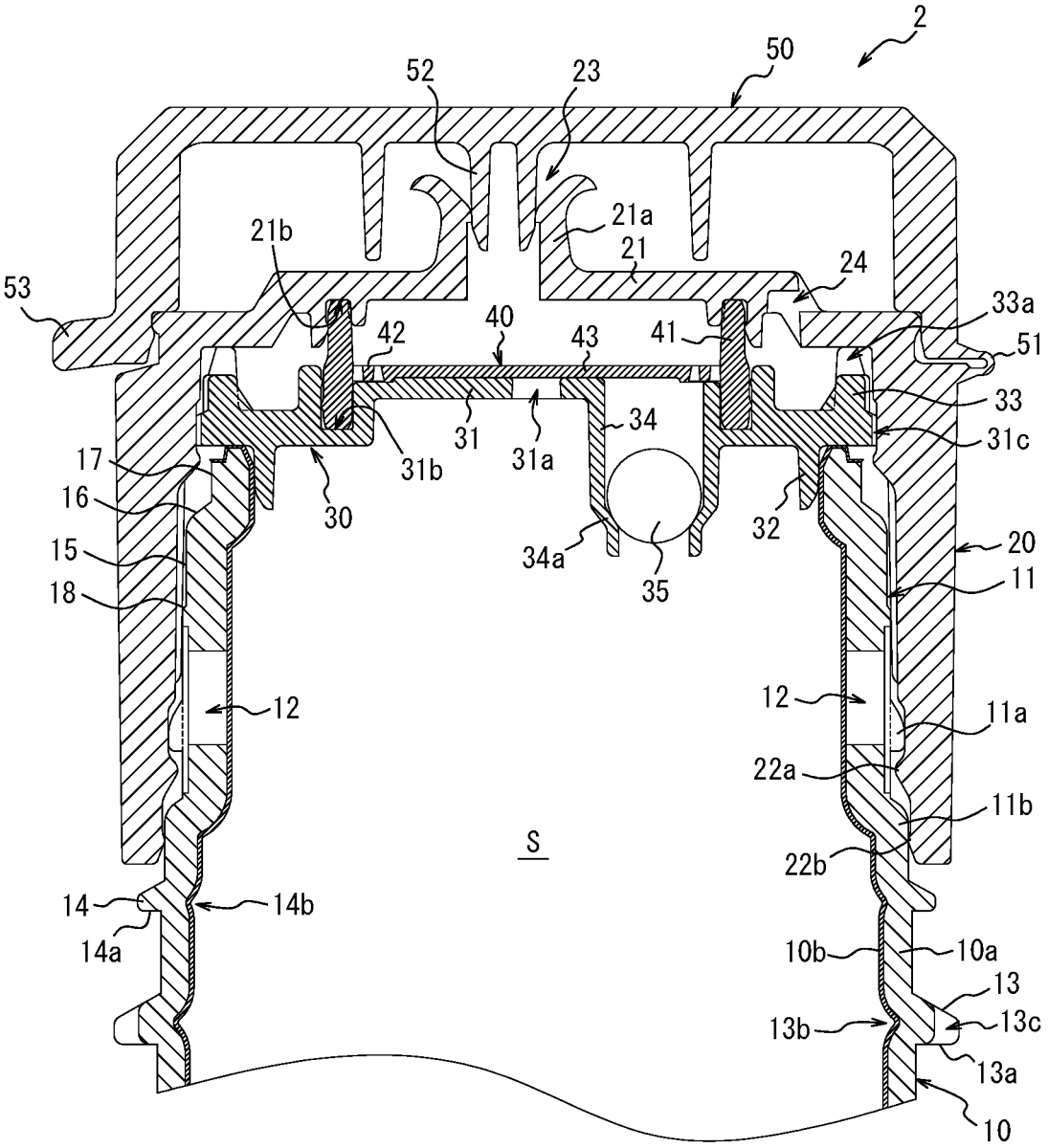
FIG. 2 is a sectional view of main parts of a discharge container according to another one of the disclosed embodiments in a side view.

In a discharge container 2 illustrated in FIG. 2, a projection 14 extending in the circumferential direction is formed between the first seal portion 11*b* and the neck ring 13. The projection 14 may have an annular shape extending on the whole circumference of the outer surface of the mouth portion 11, or may be intermittent in the circumferential direction. The projection 14 is located below the first seal portion 11*b*, with a predetermined spacing from the lower end surface 22*c* of the side wall portion 22 of the discharge cap 20 in the attached state. Thus, the lower end surface 22*c* of the side wall portion 22 and the projection 14 are kept from coming into contact with each other at the time of capping, so that deformation or damage of the discharge cap 20 and the container body 10 can be prevented reliably.

A lower surface 14*a* of the projection 14 forms a conveyance support surface supported by a conveyance tool when conveying the container body 10. In this embodiment, the projection 14 for conveyance support is provided separately from the first seal portion 11*b*. Thus, different components have separate functions. Accordingly, a decrease in seal function caused by, for example, unexpected deformation of the first seal portion 11*b* can be prevented, and stable seal performance can be achieved. The lower surface 14*a* of the projection 14 forms a flat surface perpendicular to the axis of the container. With such a structure, the container body 10 can be conveyed more stably. A predetermined space in which the conveyance tool can be inserted is formed between the projection 14 and the neck ring 13.

An annular depression 14*b* is formed at the inner surface of the part where the projection 14 is provided. If the depression 14*b* is excessively deep, the strength of the first seal portion 11*b* may decrease, or the peelability of the inner layer body 10*b* from the outer layer body 10*a* may decrease. Therefore, the depth of the depression 14*b* is preferably as shallow as possible.

The present disclosure is not limited to the embodiments described above, and various changes may be made without departing from the scope of the present disclosure. For example, the lid 50 is not limited to be connected integrally to the discharge cap 20 by the hinge 51, and may be formed separately from the discharge cap 20 and attached to the discharge cap 20 by screw-in, undercut, or the like. Moreover, an outside air introduction valve that opens and closes the suction hole 24 may be provided. For example, an annular elastic piece may project radially outward from the outer peripheral surface of the base 41 of the valve 40, and have its tip abut against the valve seat at the lower surface of the top wall portion 21 to close the suction hole 24.

REFERENCE SIGNS LIST

1 discharge container
2 discharge container
10 container body
10*a* outer layer body
10*b* inner layer body
11 mouth portion
11*a* first engagement portion
11*b* first seal portion
11*c* lower surface (conveyance support surface)
12 outside air introduction hole
13 neck ring
13*a* lower surface (capping support surface)
14 projection
14*a* lower surface (conveyance support surface)
15 first straight surface
16 first step portion (step portion)
17 second straight surface
18 second step portion
20 discharge cap
21 top wall portion
21*a* discharge cylinder
21*b* annular groove
22 side wall portion
22*a* second engagement portion
22*b* second seal portion
22*c* lower end surface
23 discharge port
24 suction hole
30 inside plug
31 partition wall
31*a* outflow hole
31*b* annular groove
31*c* ventilation groove
32 seal cylindrical portion
33 support cylindrical portion
33*a* communicating groove
34 cylindrical wall
34*a* diameter decrease portion
35 movable valve
40 valve
41 base
42 elastic piece
43 valve body
50 lid
51 hinge
52 seal wall portion
53 grip portion
S containment space

The invention claimed is:

1. A discharge container comprising:

a container body that includes an outer layer body having an outside air introduction hole in a mouth portion, and an inner layer body contained on an inner side of the outer layer body and capable of volume-reduction deformation;

a discharge cap that has a discharge port for discharging contents, and is attached to the mouth portion; and a valve that opens and closes a flow path of the contents on an inner side of the discharge cap, wherein the discharge cap includes a top wall portion having the discharge port, and a cylindrical side wall portion connected to the top wall portion, wherein an annular second seal portion and a second engagement portion are provided at an inner peripheral surface of the side wall portion, the second seal portion abutting against a first seal portion of the mouth portion located below the outside air introduction hole on a whole circumference, and the second engagement portion undercut-engaging with a first engagement portion located at an outer peripheral surface of the mouth portion above the first seal portion, and wherein the first engagement portion is intermittent in the circumferential direction and differs in position in the circumferential direction from the outside air introduction hole, wherein the first engagement portion is located at a position that overlaps the outside air introduction hole in an axial direction along a central axis of the mouth portion.

2. The discharge container according to claim 1, wherein the container body includes a neck ring located below the first seal portion with a spacing and projecting radially outward, and a lower surface of the neck ring forms a capping support surface supported by a support when pushing the discharge cap onto the mouth portion.

3. The discharge container according to claim 2, wherein an annular projection projecting radially outward is provided between the first seal portion and the neck ring, and a lower surface of the projection forms a conveyance support surface supported by a conveyance tool when conveying the container.

4. The discharge container according to claim 3, wherein the outer peripheral surface of the mouth portion includes: a first straight surface that is located above the outside air introduction hole and whose contour line in a longitudinal sectional view passing through the central axis of the mouth portion is a straight line approximately parallel to the central axis; and a second straight surface that is connected to an upper part of the first straight surface via a step portion and is smaller in diameter than the first straight surface.

5. The discharge container according to claim 2, wherein the neck ring has a notch-shaped groove portion that is a radially inward depression from an outer surface.

6. The discharge container according to claim 5, wherein the outer peripheral surface of the mouth portion includes: a first straight surface that is located above the outside air introduction hole and whose contour line in a longitudinal sectional view passing through the central axis of the mouth portion is a straight line approximately parallel to the central axis; and a second straight surface that is connected to an upper part of the first straight surface via a step portion and is smaller in diameter than the first straight surface.

7. The discharge container according to claim 2, wherein a lower surface of the first seal portion forms a conveyance support surface supported by a conveyance tool when conveying the container.

8. The discharge container according to claim 7, wherein the outer peripheral surface of the mouth portion includes: a first straight surface that is located above the outside air introduction hole and whose contour line in a longitudinal sectional view passing through the central axis of the mouth portion is a straight line approximately parallel to the central axis; and a second straight surface that is connected to an upper part of the first straight surface via a step portion and is smaller in diameter than the first straight surface.

9. The discharge container according to claim 2, wherein the outer peripheral surface of the mouth portion includes: a first straight surface that is located above the outside air introduction hole and whose contour line in a longitudinal sectional view passing through the central axis of the mouth portion is a straight line approximately parallel to the central axis; and a second straight surface that is connected to an upper part of the first straight surface via a step portion and is smaller in diameter than the first straight surface.

10. The discharge container according to claim 1, wherein a lower surface of the first seal portion forms a conveyance support surface supported by a conveyance tool when conveying the container.

11. The discharge container according to claim 10, wherein the outer peripheral surface of the mouth portion includes: a first straight surface that is located above the outside air introduction hole and whose contour line in a longitudinal sectional view passing through the central axis of the mouth portion is a straight line approximately parallel to the central axis; and a second straight surface that is connected to an upper part of the first straight surface via a step portion and is smaller in diameter than the first straight surface.

12. The discharge container according to claim 1, wherein the outer peripheral surface of the mouth portion includes: a first straight surface that is located above the outside air introduction hole and whose contour line in a longitudinal sectional view passing through the central axis of the mouth portion is a straight line approximately parallel to the central axis; and a second straight surface that is connected to an upper part of the first straight surface via a step portion and is smaller in diameter than the first straight surface.

* * * * *